US005393012A

United States Patent [19]

Dunn

[11] Patent Number: 5,393,012

[45] Date of Patent: Feb. 28, 1995

[54] CONTROL SYSTEMS FOR MOVING BODIES

[75] Inventor: Albert J. Dunn, Bangor, Co. Down, Northern Ireland

[73] Assignee: Shorts Missile Systems Limited, Belfast, Northern Ireland

[21] Appl. No.: 536,188

[22] Filed: Mar. 15, 1966

[30] Foreign Application Priority Data

Mar. 25, 1965 [GB] United Kingdom ..... 12813

[51] Int. Cl.[6] ..... F42B 10/02; F42B 10/60

[52] U.S. Cl. ..... 244/3.23; 244/3.21

[58] Field of Search ..... 244/3.11–3.19, 244/3.23, 3.1; 102/51

[56] References Cited

U.S. PATENT DOCUMENTS 2,850,251 9/1958 Joerndt ..... 244/3.13
3,067,681 12/1962 Beman ..... 244/3.19
3,111,088 11/1963 Fisk ..... 102/51

*Primary Examiner*—Ian J. Lobo
*Attorney, Agent, or Firm*—Cushman, Darby & Cushman

[57] ABSTRACT

A missile comprising a first rotatable portion arranged for rotation relative to a second rotatable portion of the missile, the first rotatable portion being adapted to be subjected to a thrust causing it to rotate in one sense during the flight of the body and in the absense of any restraining or opposing forces, and said second rotatable portion being adapted to be subjected to a thrust causing it to rotate in the opposite sense during the flight of the body, steering means on said first rotatable portion for exerting a thrust thereon away from the axis of rotation thereof to produce a steering effect on the missile or body, a free gyroscope mounted in the first rotatable portion and arranged to generate an electrical signal representative of the roll deviation of the first rotatable portion from a predetermined roll attitude in space and electromagnetic braking means responsive to said electrical signal to brake the first rotatable portion against the second rotatable portion to bring said first rotatable portion to said predetermined roll attitude and to hold it in that attitude.

14 Claims, 1 Drawing Sheet

CONTROL SYSTEMS FOR MOVING BODIES

The present invention relates to control systems for moving bodies and is particularly though not exclusively concerned with a remote control system for an aerial body such as a missile.

In the copending U.S. patent application Ser. No. 373,881, filed Jun. 9, 1964 in the name of John L. Sendles and now abandoned in favor of a continuation application, Ser. No. 04/660,873, filed Aug. 4, 1967 still pending, there is described a missile including a nose portion which is rotatably mounted in bearings on the forward end of the main body portion of the missile for rotation about the longitudinal axis of the missile, and the nose portion is provided with a pair of pivotally mounted aileron control surfaces and a pair of pivotally mounted elevator control surfaces. A remote control system is provided for guiding the missile so that an operator at a ground station can bring the nose portion of the missile to a preselected roll attitude by appropriate remote operation of the aileron control surfaces and then subject the missile to a lateral steering thrust by appropriate remote operation of the elevator control surfaces.

It is however sometimes convenient or advantageous to employ in the place of the above described "twist and steer" mode of control an alternative form of control in which two pairs of elevator control surfaces are employed for steering the missile in its pitch and yaw planes simultaneously whilst maintaining the body or the portion of its carrying the control surfaces in a roll-stabilised attitude, and it is an object of the present invention to provide a missile having means for controlling the flight of the missile in this way.

According to the present invention, there is provided a missile or other moving body comprising a first rotatable portion arranged for rotation relative to a second rotatable portion of the missile, the first rotatable portion being adapted to be subjected to a thrust causing it to rotate in one sense during the flight of the body and in the absence of any restraining or opposing forces and said second rotatable portion being adapted to be subjected to a thrust causing it to rotate in the opposite sense during the flight of the body, means for braking the first rotatable portion against the second rotatable portion to bring said first rotatable portion to a predetermined roll attitude and to hold it in that attitude, and means on said first rotatable portion for exerting a thrust thereon away from the axis of rotation thereof to produce a steering effect on the missile or body in each of the pitch and yaw planes of the missile or body.

The term "missile" as used herein, and in the claims, is intended to encompass moving bodies susceptible of being controlled as disclosed herein.

One embodiment of the invention will now be described by way of example with reference to the accompanying drawing in which.

Figure 1:
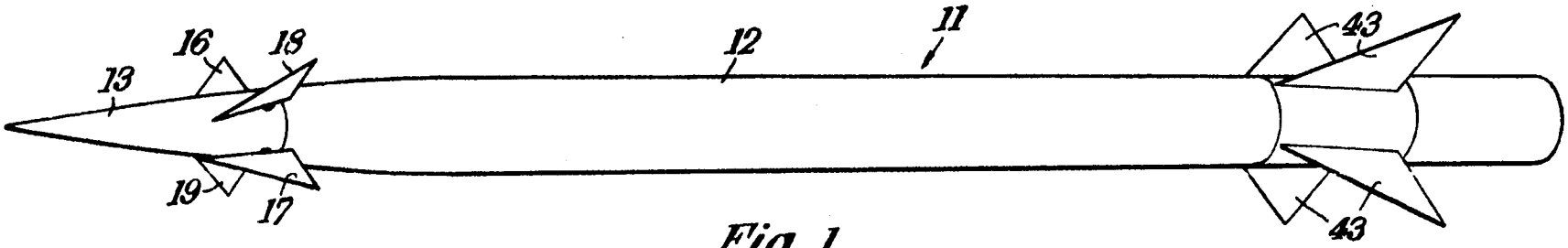
FIG. 1 is a general side view of a missile according to the invention.
Figure 2:
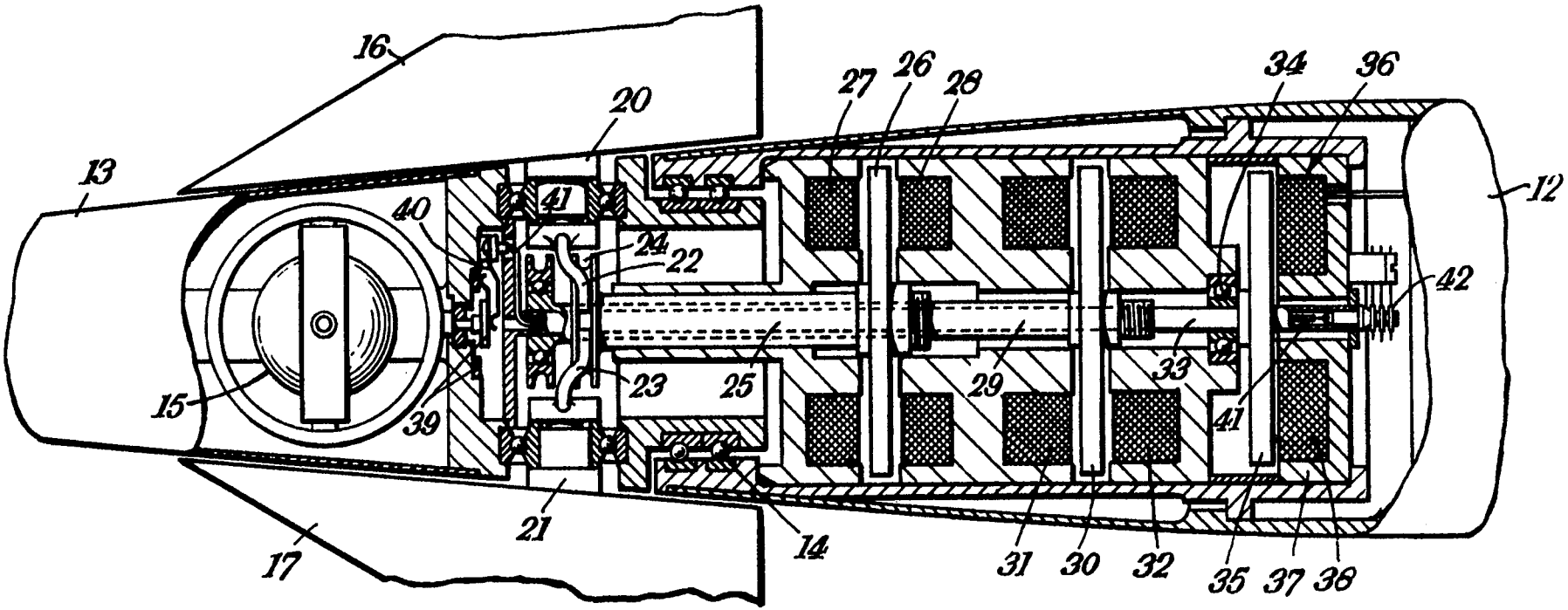
FIG. 2 is a part sectional plan view of a portion of the missile shown in FIG. 1.

Referring to the drawing, a missile 11 comprises a main body portion 12 and a nose portion 13 which is rotatably mounted in bearings 14 on the forward end of the main body portion 12 for rotation about the longitudinal axis of the missile and which houses a free gyroscope 15 which is arranged to generate an electrical signal representative of the roll attitude of the nose portion 13 with respect to a predetermined datum attitude in space. The nose portion 13 carries two pairs of elevator control surfaces 16,17 and 18,19. The elevator control surfaces 16 and 17 are carried by shafts 20 and 21 rotatably mounted in bearings in the nose portion for rotation about a common lateral axis, and the inner ends of the shafts 20 and 21 are provided with eccentrically mounted pins 22 and 23 which engage in a peripheral groove 24 in the head of a hollow push rod 25 which extends into the nose portion 13 from the body portion 12. Within the body portion 12, the push rod 25 is formed with a diaphragm 26 which serves as an armature cooperating with a pair of solenoid coils 27 and 28 energised in a manner hereinafter to be described, the arrangement being such that upon energisation of the coils 27 and 28 in one sense the push rod 25 is moved forward into the nose portion 12, acting on the eccentric pins 22 and 23 and serving to move the pair of elevator control surfaces 16 and 17 in the same sense, and upon energisation of the coil 27 and 28 in the opposite sense the push rod 25 is moved to a retracted position causing the elevator control surfaces 16 and 17 to move in the opposite sense. For the purpose of the present description these control surfaces will be referred to as the pitch control surfaces.

The further pair of elevator control surfaces 18 and 19 are mounted for rotation about a common lateral axis at right angles to the common lateral axis of the pitch control surfaces 16 and 17. These further control surfaces, hereinafter referred to as the yaw control surfaces 18 and 19, are mounted in the same manner as the pitch control surfaces 16 and 17 and are operated in a like manner by a further push rod 29 slidably mounted in a longitudinal bore through the push rod 25 and controlled by a further diaphragm 30 cooperating with a further pair of solenoid coils 31 and 32 mounted in the body portion 12 of the missile behind the solenoid coils 27 and 28.

The further push rod 29 for controlling the yaw control surfaces 18 and 19 is also of hollow form and is slidably and rotatably mounted on a rearwardly extending hollow spigot 33 fixed at its forward end in the nose portion 13 and extending rearwardly into the body portion 12 along the longitudinal axis of the missile. The rear end of a hollow spigot 33 is rotatably mounted in bearings 34 in the body portion 12 and has fixed thereon a circular clutch plate 35 mounted concentrically with respect to the axis of the missile. The clutch plate 35 forms part of a solenoid-operated clutch 36 having a stator body 37 carrying energising windings 38 and arranged in cooperating relation with the clutch plate 35. The windings 38 are fed with energising current obtained from the output of an electrical signal derived from the free gyroscope 15 and representative of the angular deviation of the nose portion 13 from a predetermined datum roll attitude, the electrical signal being obtained from a potentiometer 39, the wiper of which is connected via a resilient contact 40 to a lead 41 which passes through the hollow spigot 33 to a slip-ring 42 connected to the input of the amplifier.

The main body portion 12 of the missile is provided with stabilising fins 43 which are present to impart to the main body portion 12 a rotation thereof in one sense. The pitch and yaw control surfaces 16, 17 and 18,19 are present occupy positions in which they cause the nose portion to rotate in the opposite sense in the absence of any restraining forces applied by the solenoid operated clutch 36. However, the clutch 36 becomes energised by the signal from the gyroscope 15, the magnitude of which represents the deviation of the nose portion 13 from the datum roll attitude, and as a result the nose portion 13 is braked by an amount dependent upon its roll deviation from the datum attitude, the arrangement being such that the speed of the nose portion 13 relative to the body portion 12 is so controlled as to hold the nose portion 13 at the predetermined datum roll attitude.

With the nose portion 13 maintained in the datum roll attitude during the flight of the missile, the latter may be steered by appropriate movements of the pitch and yaw control surfaces and for this purpose signals are transmitted from a ground control station and after modification in a receiver in the missile are applied to energise the solenoids 27,28 and 31,32 controlling the movements of the control surfaces. In this way the missile may be steered simultaneous in the pitch and yaw planes.

A control system as described in our U.S. application Ser. No. 04/660,873 may be employed to control the actuation of the control surfaces 16,17 and 18,19, the required pitch and yaw control signals being transmitted to the missile from a ground station in the manner described in our U.S. patent application.

What I claim as my invention and desire to secure by Letters Patent is:

1. A missile comprising a first rotatable portion arranged for rotation relative to a second rotatable portion of the missile, the first rotatable portion being adapted to be subjected to a thrust causing it to rotate in one sense during the flight of the body and in the absense of any restraining or opposing forces, and said second rotatable portion being adapted to be subjected to a thrust causing it to rotate in the opposite sense during the flight of the body, steering means on said first rotatable portion for exerting a thrust thereon away from the axis of rotation thereof to produce a steering effect on the missile or body, a free gyroscope mounted in the first rotatable portion and arranged to generate an electrical signal representative of the roll deviation of the first rotatable portion from a predetermined roll attitude in space and electromagnetic braking means responsive to said electrical signal to brake the first rotatable portion against the second rotatable portion to bring said first rotatable portion to said predetermined roll attitude and to hold it in that attitude.

2. A missile according to claim 1, wherein said braking means comprises an electromagnetic clutch having a stator mounted in the second rotatable portion of the missile and provided with an energising winding, and a clutch plate arranged in cooperating relation with the stator and arranged to rotate with the first rotatable portion.

3. A missile according to claim 2, wherein said wherein the energising winding is arranged to be fed with energising current obtained from the output of an amplifier, the input of which is arranged to be fed with the electrical signal derived from the free gyroscope and representative of the roll deviation of the first rotatable portion.

4. A missile according to claim 3, wherein said steering means comprises a pair of variable-incidence pitch control surfaces mounted on the first rotatable portion for rotation about a common lateral axis and a pair of variable-incidence yaw control surfaces mounted on the first rotatable portion for rotation about a common lateral axis at right angles to said pitch control surfaces.

5. A missile according to claim 4, wherein the first rotatable portion is adapted to be subjected to an aerodynamic thrust causing it to rotate in said one sense and said second rotatable portion is adapted to be subjected to an aerodynamic thrust causing it to rotate in the said opposite sense.

6. A missile according to claim 5, wherein the pitch and yaw control surfaces are preset to occupy positions in which they cause the first rotatable portion to rotate in the said one sense in the absence of any restraining forces thereon applied by said braking means.

7. A missile according to claim 4 wherein said first rotatable portion is constituted by a nose portion of the missile which is mounted for rotation about the longitudinal axis of the missile on the forward end of a main body portion of the missile constituting said second rotatable portion, wherein said pitch and yaw control surfaces are arranged for separate actuation by first and second actuator mechanisms movable in response to the energisation of first and second electromagnetic coils forming parts of the mechanisms and contained in the main body portion of the missile, said coils being mounted in spaced relation in the said body portion along the rotary axis thereof and concentric with respect thereto with the first coil nearer to the rotatable portion than the second coil, the first actuator mechanism comprising an axially movable sleeve coaxial with the rotary axis and extending at one end into the nose portion and at the other end carrying an armature disc mounted concentrically with respect to the sleeve and in cooperating relation with the first coil which upon energisation causes the disc in the sleeve to move axially to effect actuation of one of the pairs of control surfaces, and the second actuator mechanism comprising an axially movable shaft coaxial with the rotary axis and slidable within the sleeve, said shaft extending beyond said sleeve at each end, one end of the shaft extending into the rotatable portion of the missile and the other end carrying a further armature disc concentric with the shaft and arranged in cooperating relation with the second coil which upon energisation causes the further disc and the shaft to move axially to effect actuation of the other of the pairs of control surfaces.

8. A missile according to claim 7, wherein the main body portion of the missile is provided with stabilising fins which are preset to impart to the main body portion a rotation thereof in said opposite sense.

9. A missile according to claim 7, wherein the shaft is provided with a longitudinal bore therethrough wherein a spigot is secured to the nose portion of the missile and extends rearwardly into the main body portion through the hollow shaft, and wherein the clutch plate is fixidly mounted on the rear end of the spigot.

10. A missile comprising a first rotatable portion arranged for rotation relative to a second rotatable portion of the missile, a pair of variable-incidence pitch control surfaces mounted on the first rotatable portion for rotation about a common lateral axis and a pair of variable-incidence yaw control surfaces mounted on the first rotatable portion for rotation about a common lateral axis at right-angles to the common lateral axis of said pitch control surfaces, said pitch and yaw control surfaces being pre-set always to occupy positions in which they cause the first rotatable portion to rotate in one sense in the absense of any restraining or opposing forces, and said second rotatable portion having means subjecting it to a thrust causing it to rotate in the opposite sense during the flight of the body, braking means for braking the first rotatable portion against the second rotatable portion to bring said first rotatable portion to a predetermined roll attitude in space and to hold it in that attitude, and first and second actuator mechanisms for actuating said pitch and yaw control surfaces in response to steering signals applied thereto to steer the missile by pitch and yaw movements.

11. A missile comprising a first rotatable portion arranged for rotation relative to a second rotatable portion of the missile, the first rotatable portion being subjected to a thrust causing it to rotate in one sense during the flight of the body and in the absense of any restraining or opposing forces and said second rotatable portion being subjected to a thrust causing it to rotate in the opposite sense during the flight of the body, braking means for braking the first rotatable portion against the second rotatable portion to bring said first rotatable portion to a predetermined roll attitude in space and to hold it in that attitude, a pair of variable-incidence pitch control surfaces mounted on the first rotatable portion for rotation about a common lateral axis, a pair of variable-incidence yaw control surfaces mounted on the first rotatable portion for rotation about a common lateral axis at right angles to the common lateral axis of said pitch control surfaces, and pitch and yaw actuator mechanisms for actuating said pitch control surfaces and said yaw control surfaces in response to steering signals applied thereto.

12. A missile comprising a first rotatable portion arranged for rotation relative to a second rotatable portion of the missile, the first rotatable portion being subjected to a thrust causing it to rotate in one sense during the flight of the body and in the absense of any restraining or opposing forces and said second rotatable portion being subjected to a thrust causing it to rotate in the opposite sense during the flight of the body, braking means for braking the first rotatable portion against the second rotatable portion to bring said first rotatable portion to a predetermined roll attitude in space and to hold it in that attitude, variable-incidence control surfaces mounted on the first rotatable portion and actuator means responsive to steering signals applied thereto to actuate the control surfaces to steer the missile by pitch and yaw movements thereof.

13. A missile according to claim 12, wherein the variable-incidence control surfaces are pre-set to occupy positions in which they cause the first rotatable portion to rotate in the said one sense in the absense of any restraining forces thereon applied by said braking means.

14. A missile according to claim 13, wherein said variable-incidence control surfaces comprise a pair of pitch control surfaces mounted on the rotatable portion for rotation about a common lateral axis and a pair of yaw control surfaces mounted on the first rotatable portion for rotation about a common lateral axis at right-angles to said pitch control surfaces.

* * * * *